US007218871B2

(12) United States Patent
Ogata

(10) Patent No.: US 7,218,871 B2
(45) Date of Patent: May 15, 2007

(54) IMAGE FORMING APPARATUS AND METHOD OF CONTROLLING SAME

(75) Inventor: Hiroaki Ogata, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 11/135,284

(22) Filed: May 24, 2005

(65) Prior Publication Data

US 2005/0265738 A1 Dec. 1, 2005

(30) Foreign Application Priority Data

May 25, 2004 (JP) ..... 2004-155178
May 18, 2005 (JP) ..... 2005-145883

(51) Int. Cl.
*G03G 15/00* (2006.01)
*G03G 15/08* (2006.01)

(52) U.S. Cl. ..... 399/27; 399/61

(58) Field of Classification Search ..... 399/27, 399/24, 58, 61, 258, 260, 262; 222/DIG. 1
See application file for complete search history.

(56) References Cited

U.S. PATENT DOCUMENTS 6,347,199 B1 * 2/2002 Morihara ..... 399/27
2002/0141765 A1 * 10/2002 Phillips ..... 399/27
2003/0133722 A1 * 7/2003 Kaiho ..... 399/27
2004/0062559 A1 * 4/2004 Kinoshita et al. ..... 399/27
2005/0117920 A1 * 6/2005 Ogata et al. ..... 399/27
2005/0201764 A1 * 9/2005 Okamoto et al. ..... 399/27 X

FOREIGN PATENT DOCUMENTS

JP 59-53856 3/1984
JP 59-61842 4/1984
JP 63-10231 1/1988
JP 2575404 B2 10/1996
JP 9-90730 4/1997
JP 2005-084072 A * 3/2005

* cited by examiner

*Primary Examiner*—Sophia S. Chen
(74) *Attorney, Agent, or Firm*—Fitzpatrick, Cella, Harper & Scinto

(57) ABSTRACT

When it has been estimated that there is substantially no toner remaining in a toner supply unit based upon the amount of toner that has been supplied from the toner supply unit, a supply roller for supplying toner from the toner supply unit to a developing unit is rotated by a prescribed amount. After the supply roller has thus been rotated, a user is notified of the fact that no toner remains in the toner supply unit.

28 Claims, 8 Drawing Sheets

IMAGE FORMING APPARATUS AND METHOD OF CONTROLLING SAME

FIELD OF THE INVENTION

This invention relates to an image forming apparatus for forming an image using a developer supplied from a developer supply unit, and to a method of controlling this apparatus.

BACKGROUND OF THE INVENTION

Conventionally, an image forming apparatus that uses an electrophotographic image process employs a process cartridge system in which a developing unit, a photosensitive drum and process means for acting upon the photosensitive drum are integrated into the form of a cartridge and the cartridge is capable of being removably installed in the main body of the image forming apparatus. In accordance with this process cartridge system, maintenance of the image forming apparatus can be performed by a user himself without relying upon a serviceman, thereby greatly enhancing operability. For this reason, such an image forming apparatus is in wide use.

However, because the amount of toner that can be contained in the cartridge is limited, this process cartridge system has certain drawbacks.

Specifically, when an image forming apparatus has a high frequency of use, a process cartridge system with a small toner capacity requires that the cartridge be replaced very frequently and, as a result, usability is poor. Further, when the cartridge is replaced, not only the toner but also the cartridge components (photosensitive drum and charge roller, etc.) and developing unit are replaced in their entirety. This invites an increase in running cost.

Accordingly, a toner supply system in which the developing unit, etc., is placed on the side of the main body of the image forming apparatus and use is made of a so-called toner supply cartridge that merely supplies toner from the cartridge has become the most widely employed system in equipment such as copiers that have a high frequency of use. A disadvantage of this toner supply system is that maintenance of the image forming apparatus such as replacement of consumable parts is almost impossible for the user to perform. This makes maintenance by a serviceman necessary and increases the burden upon the user.

A toner-supply-type process cartridge that has the advantages of both the process cartridge system and toner supply system has been proposed in recent years. This system comprises at least a process cartridge, which has a developing unit for visualizing by toner an electrostatic latent image formed on an image carrier (photosensitive drum), and a toner supply unit for supplying the developing unit with toner. By removably installing these two units in the main body of an image forming apparatus, maintenance and usability are improved and running cost is lowered.

Such a toner supply unit has means for sensing the amount of toner in the toner supply unit and, based upon the result of sensing, is capable of notifying the user of the fact that the toner supply unit should be replaced. An example of means of sensing the amount of toner in the toner supply unit is (A) an arrangement in which the toner supply unit is provided with various well-known sensors, such as by providing the inner wall of the vessel with a piezoelectric sensor and sensing the electrostatic capacitance of the toner, and in which a light-transmitting system, etc., is used. Further, as described in Japanese Patent No. 2575404, (B) there is a method in which means for sensing the mixing ratio (toner concentration) of, e.g., a two-component developer consisting of toner and carrier is provided on the side of the developing unit that is supplied with the toner. When the output of the toner concentration sensing means is equal to or greater than a fixed value (i.e., when the toner concentration is below a fixed value), it is sensed that there is no toner in the toner supply unit on the grounds that toner is no longer being supplied. Further, (C) there is a method which relies upon toner consumption information as from the output of a toner concentration sensor or from image dot information, wherein the total amount of toner that has been supplied is estimated by adding up and storing the number of revolutions of a toner supply screw of the toner supply unit and the absence of toner is sensed based upon the result of the estimation.

In the case of (A), the fact that the toner supply unit is provided with sensing means for sensing the amount of toner directly makes it possible to give an indication of remaining amount of toner during usage and to notify of the absence of toner at an appropriate timing. However, a problem is that the cost of the toner supply unit, which is the replaceable unit, rises by an amount commensurate with the sensing means provided.

Further, in the case of (B), notification of absence of toner can be given at the stage at which the toner supply unit truly runs out of toner. However, an indication of remaining amount of toner during usage cannot be presented and it is also not possible to give an early warning indicating approximately how much longer the toner supply unit can be used until replacement is required. Further, in the case of (C), which is the converse of (B), the amount of consumed toner can be estimated by adding up and storing the number of revolutions of the toner supply screw, which has a strong relationship to amount of consumed toner. This is extremely effective in that the amount of toner remaining in the toner supply unit during usage can be displayed in stages and the user can be notified of the timing for replacement of the toner supply unit. However, at the stage where absence of toner is determined, an error with respect to the actual amount of remaining toner can occur and there is the danger that the user will be alerted in advance to replace the toner supply unit regardless of the fact that toner still remains. By combining (B) and (C), an indication of amount of remaining toner can be presenting during usage and the user can be notified of absence of toner at the stage where the toner supply unit has actually run out of toner. In this case, however, a discrepancy develops in the period of time from estimation of absence of toner to sensing of the fact that toner has actually run out. For example, once an indication that the amount of remaining toner is 1% is given, it may be a long while before toner actually runs out and printing becomes impossible. On the other hand, printing may become impossible in a short period of time following the indication. Thus there is the possibility that the user will become confused.

SUMMARY OF THE INVENTION

Accordingly, an object of the present invention is to eliminate the aforesaid drawbacks of the prior art.

A feature of the present invention is to provide an image forming apparatus and method of controlling the same, in which the amount of developer remaining in a developer supply unit is estimated and, after it has been estimated that there is substantially no developer remaining, information indicating the absence of developer is output following true depletion of the developer.

According to an aspect of the present invention, there is provided with an image forming apparatus for forming an image by developing the image by a developing unit using a developer supplied from a replaceable developer supply unit, the apparatus comprising:

driving means for driving into rotation a developer supply roller inside the developer supply unit;

estimating means for estimating amount of developer remaining inside the developer supply unit;

supply driving means for driving the driving means a prescribed amount in a case where it has been estimated by the estimating means that there is substantially no developer remaining; and output means for outputting information, which indicates that there is no developer remaining inside the developer supply unit, after the supply driving means has driven the driving means.

Further, according to another aspect of the present invention, there is provided with a method of controlling an image forming apparatus for forming an image by developing the image by a developing unit using a developer supplied from a developer supply unit, the method comprising:

a first sensing step of sensing an amount of developer remaining in the developer supply unit;

a second sensing step of sensing an amount of developer in the developing unit; and a first driving step of driving a developer supply section, which is for supplying a developer from the developer supply unit to the developing unit, based upon result of sensing in the second sensing step; and a second driving step of driving the developer supply section a prescribed amount while image formation is being carried out, in a case where it is has been sensed in the second sensing step that there is substantially no developer remaining in the developer supply unit.

The gist of the present invention is not an enumeration of all the necessary features thereof, and therefore combinations of these features are also covered by the present invention.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. Note that the following embodiments do not limit the invention recited in the claims. Further, all combinations of features described in the embodiments are not essential to the solution presented by the present invention.

Further, the dimensions, materials, shapes and relative placement of the structural parts described in the following embodiments are merely examples unless it is specifically stated otherwise and that the scope of the present invention is in no way limited thereby. Further, once the materials and shapes of member have been described below, they need not be described again unless it is specifically stated otherwise.

FIRST EMBODIMENT

Figure 1:
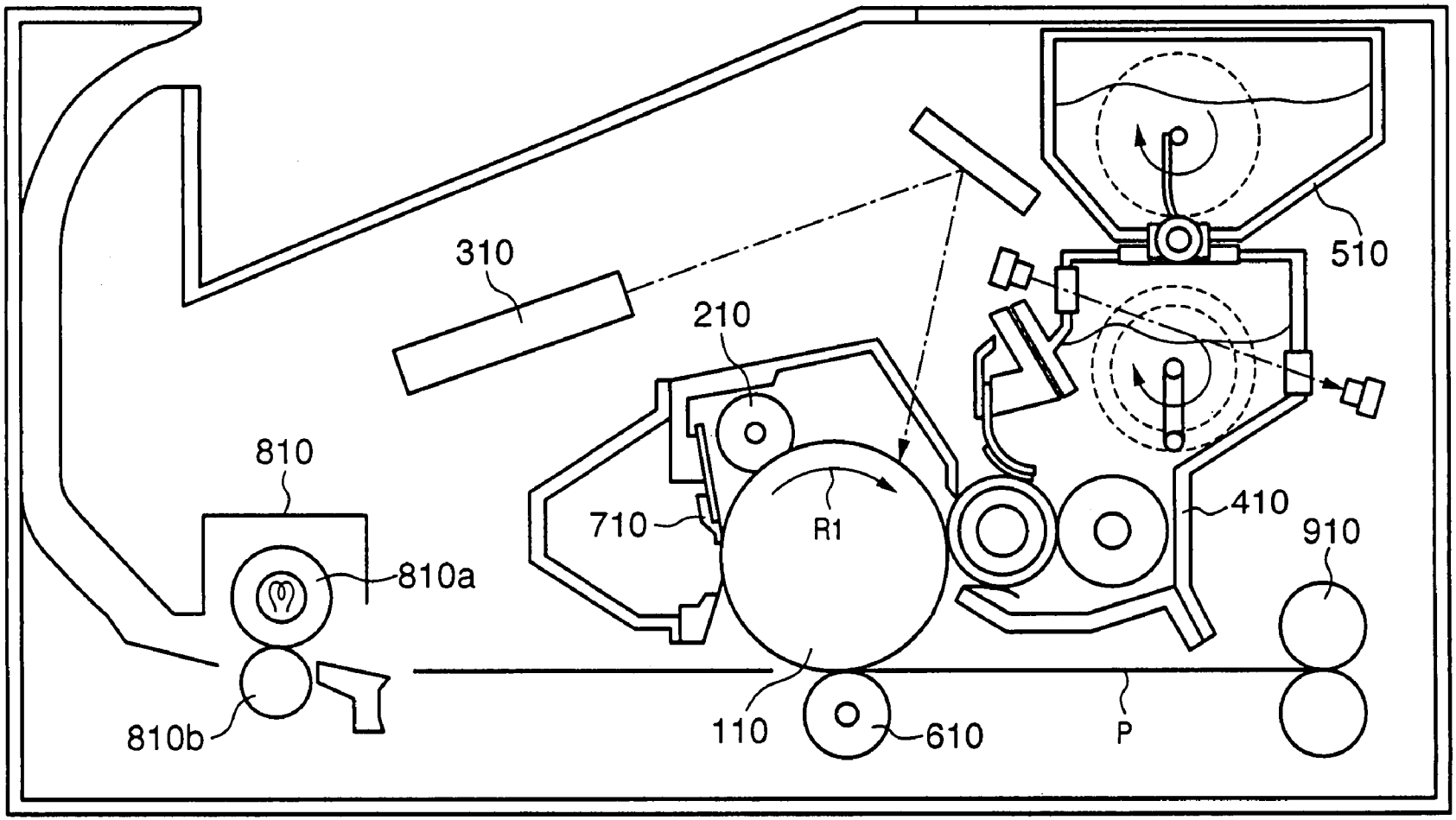
FIG. 1 depicts a sectional view illustrating the structure of the image forming section of an image forming apparatus according to a first embodiment of the present invention.

FIG. 1 depicts a sectional view illustrating the structure of an image forming section of an image forming apparatus (laser printer) according to a first embodiment of the present invention. It should be noted that the first embodiment will be described with regard to a case where the apparatus is an image forming apparatus that forms an image using a single color, which is black. However, the present invention is not limited to this embodiment and is also applicable to a color image forming apparatus that forms an image in multiple colors such as Y (yellow), M (magenta), C (cyan) and Bk (black).

Furthermore, the image forming apparatus according to first and second embodiments set forth below form an image on a recording medium using an electrophotographic image forming method, examples being an electrophotographic printer (e.g., a laser printer and LED printer, etc.), a facsimile machine and a word processor, etc. Further, a process cartridge refers to a cartridge, having at least a developing unit, integrated with, e.g., a photosensitive drum. The cartridge is removably installed in the main body of the image forming apparatus. Further, a developer supply unit refers to a unit that supplies a developer (toner) to the developing unit inside the process cartridge and that is removably installed in the main body of the image forming apparatus.

The image forming apparatus according to the first embodiment is equipped with an image carrier (referred to as a photosensitive drum below) on which an electrostatic latent image is formed; a developing unit for developing the electrostatic latent image with developer; a developer supply unit (referred to as a toner supply unit below) for supplying the developer to the developing unit; and a controller for controlling the supply of developer from the toner supply unit.

The image forming apparatus is such that a drum-shaped electrophotographic photosensitive body, namely a photosensitive drum 110, is supported substantially at the center of the apparatus so as to be rotatable in the direction of an arrow R1. When an image forming operation begins, the surface of the photosensitive drum 110 is charged uniformly by a charge roller 210. The surface of the photosensitive drum 110 is thenceforth exposed by a laser beam, which conforms to image information, emitted from a laser emitter 310 serving as exposure means, whereby an electrostatic latent image corresponding to the image information is formed on the surface of the photosensitive drum 110.

In the first embodiment, the charge on the photosensitive drum 110 is of negative polarity. The electrostatic latent image corresponding to the image information is formed on portions of the drum surface where the negative electric charge has been attenuated by the exposing light of the laser beam from the laser emitter 310. The electrostatic latent image is subsequently visualized by toner, which is one type of developer, supplied from a developing unit 410 as the photosensitive drum 110 rotates, as a result of which a toner image is formed on the photosensitive drum 110.

In the first embodiment, the developing method is a reflective developing method. This means that toner of the same polarity (negative) as the electric charge to which the drum has been charged attaches itself to portions (image portions) where the electric charge of the negatively charged photosensitive drum 110 has been attenuated. Further, toner is supplied from a toner supply unit (toner cartridge) 510, which serves as developer accommodating means, to the developing unit 410.

Meanwhile, a printing medium (printing sheet) P accommodated in a paper cassette (not shown) is transported by rotation of feed rollers 910 to a transfer area where the photosensitive drum 110 and a transfer roller 610 serving as image transfer means are in abutting contact. The printing sheet is transported in sync with arrival at the transfer area of the toner image on the photosensitive drum 110. When the toner image on the photosensitive drum 110 and the printing sheet P arrive at the transfer area, the toner image on the photosensitive drum 110 is transferred onto the printing sheet P by a transfer electric field formed in the transfer area by the transfer roller 610. The unfixed toner image carried on the printing sheet P is subsequently heated and pressured by fixing means (a heating roller) 810*a* and a pressure roller 810*b*, respectively, provided in a fixing unit 810, whereby the toner image is fixed permanently on the printing sheet P.

Further, toner remaining on the surface of the photosensitive drum 110 for which the transfer of the toner image has been completed is removed by a cleaning unit 710 having blade-like cleaning means. Thus the drum is prepared for a successive image forming operation.

The developing unit 410 and toner supply unit 510 will now be described in further detail.

Figure 2:
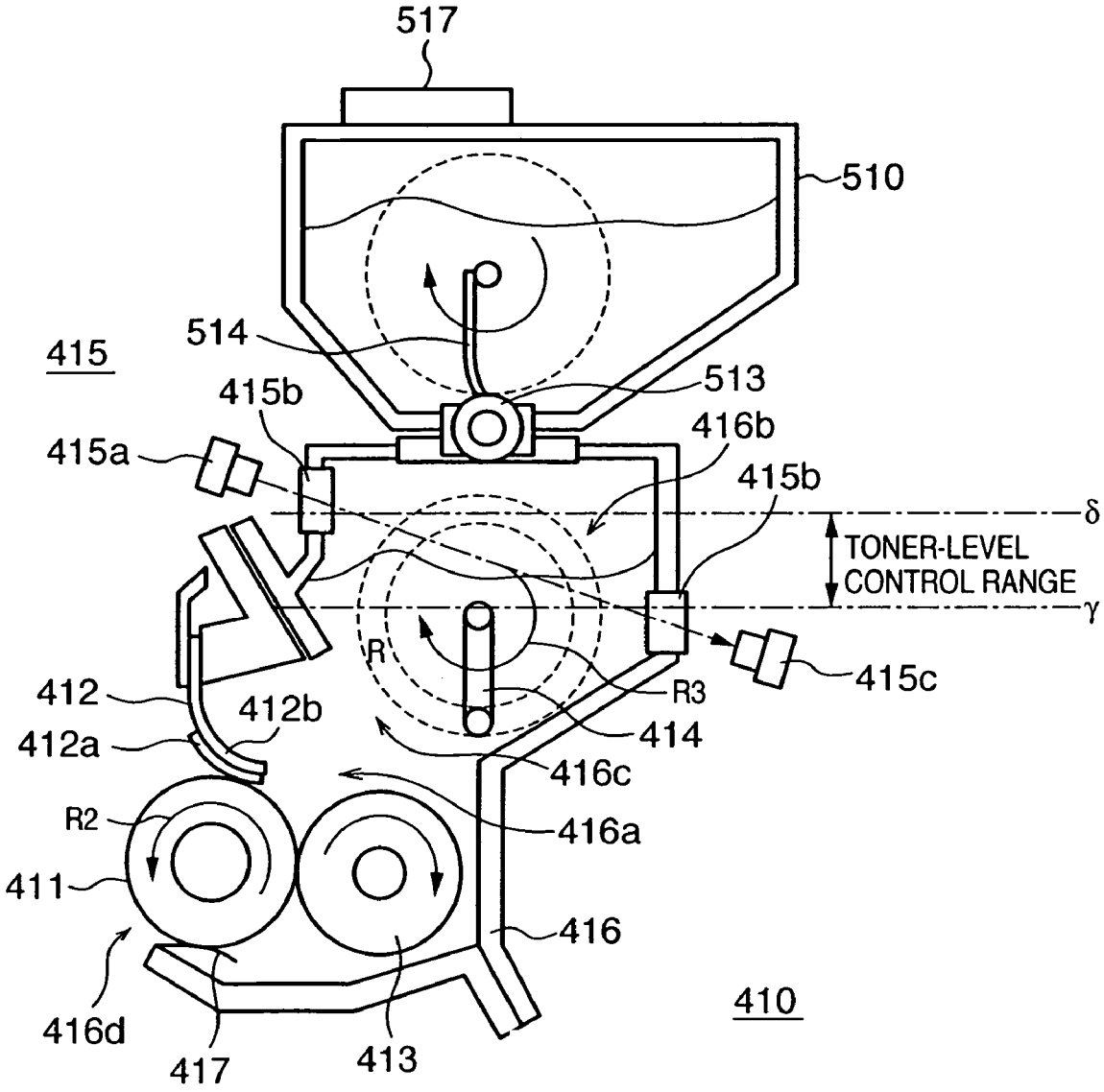
FIG. 2 depicts a sectional view illustrating the principal components of a developing unit and toner supply unit according to the first embodiment.

FIG. 2 depicts a sectional view illustrating the principal components of the developing unit 410 and toner supply unit 510 according to the first embodiment. Components identical with those in FIG. 1 are designated by like reference characters.

In the first embodiment, the developing unit 410 comprises a developer carrier (referred to as a developing roller 411 below) for carrying and transporting a developer (toner) and bringing the developer into contact with the photosensitive drum 110 to thereby develop the electrostatic latent image; a developer supply section (supply roller 413 below) for supplying developer to the developing roller 411; a developer regulator (blade 412 below) for regulating the developer supplied by the supply roller 413 and forming a thin layer of the developer on the developing roller 411; a developer stirring member (stirring member 414 below) capable of moving in order to mix developer, which is supplied from the developer supply unit 510 by rotation of a supply roller 513, and developer inside the developing unit 410; and a level sensor (toner level sensing unit 415 below) for sensing the level (height) of the developer in the vicinity of the stirrer. It should be noted that the developing unit 410 employs a contact developing method in which the developing roller 411 is brought into contact with the photosensitive drum 110 and the image is developed in a state in which the developer has been brought into contact with the photosensitive drum 110.

Further, the used developer in the first embodiment is a negatively charged, non-magnetic single-component developer (toner). More specifically, the developer is a toner that forms an internal structure incorporating a substance having a low softening point, thereby conserving energy in the fixing unit 810. A developer fabrication method that relies upon suspension polymerization is used as the toner fabrication method. For example, this method is described in the specifications of Japanese Patent Publication 63-10231, Japanese Patent Application Laid-Open No. 59-53856 and Japanese Patent Application Laid-Open No. 59-61842.

Further, the toner used in the first embodiment is spherical toner having a volumetric particle diameter of 6 μm. The toner has a so-called core/shell internal structure in which a substance having a low softening point is covered with a resin shell. The shell portion in this structure is formed by a polymerization method. In accordance with the suspension polymerization method under ordinary room temperature or pressure, finely divided spherical particles having a particle diameter of 3 to 8 μm are obtained comparatively easily over a sharp particle size distribution. As a result, the distribution of ratio of mass to electric charge also becomes sharp and uniform development that conforms to development contrast is achieved.

Methods other than the suspension polymerization method may also be employed. For example, it is possible to use a toner manufactured by a dispersion polymerization method in which the toner is produced directly using a water-based organic solvent in which a monomer is soluble and the polymer obtained by polymerization is insoluble, and an emulsion polymerization method, which is typified by a soap-free polymerization method, in which the toner is produced by direct polymerization in the presence of an aqueous polar polymerization initiator.

The toner used as the developer in the first embodiment is substantially spherical in shape and has a shape coefficient SF-1 ranging from 100 to 140 and a shape coefficient SF-2 ranging from 100 to 120. The shape coefficients SF-1 and SF-2 are defined as values obtained by sampling 100 toner images randomly using an FE-SEM (S-800) manufactured by Hitachi, Ltd., inputting the resulting image information to an image analyzer (Luzex3), which is manufactured by Nikore K.K., via an interface, to thereby analyze the information, and performing calculations indicated by the following Equations (1) and (2):

$$SF\text{-}1=(MXLNG)2/\mathrm{AREA}\times(\pi/4)\times 100 \quad \text{Eq. (1)}$$

$$SF\text{-}2=(PERI)2/\mathrm{AREA}\times(1/4\pi)\times 100 \quad \text{Eq. (2)}$$

where AREA, MXLNG and PERI represent a toner projection area, and an absolute maximum length of the projected image and perimeter of the projected image, respectively. Further, the shape coefficient SF-1 indicates the degree of sphericality. As SF-1 exceeds 140, the shape of the particles gradually becomes less spherical and the particles become irregular in shape. The shape coefficient SF-2, on the other hand, indicates the degree of roughness. As SF-2 exceeds 120, surface roughness becomes more pronounced.

In the first embodiment, an additive such as silica in added to the toner in order to improve such characteristics as chargeability and fluidity. Alternatively, other additives can be selected appropriately if they have similar functions. Examples are metal oxides such as aluminum oxide, tin oxide, strontium titanate, zinc oxide and magnesium oxide; nitrides such as silicon nitride; carbides such as silicon carbide; carbon allotropes such as carbon black and graphite; metal salts such as calcium sulfate, barium sulfate and calcium carbonate; and fatty metal salts.

Toner having an internal structure, inclusive of the core/shell structure, is such that this structure can sometimes be destroyed by the load that accompanies the image forming operation. In this case the toner loses its rigidity and readily becomes fused to the developing roller 411 and blade 412.

The members disposed in the developing unit 410 according to the first embodiment will now be described with reference to FIG. 2.

The developing unit 410 accommodates toner in a developing vessel 416. The developing vessel 416 has a developing chamber 416*a* in which the developing roller 411, supply roller 413 and blade 412 are placed; a stirring chamber 416*b* in which the stirring member 414 is placed; and an opening 416*c* provided in order that toner will migrate from the stirring chamber 416*b* to the developing chamber 416*a*. The stirring chamber 416*b* is placed above the developing chamber 416*a* with the opening 416*c* interposed therebetween.

The developing vessel 416 is provided with an opening 416*d* in a part on the side thereof that opposes the photosensitive drum 110. The developing roller 411 is partially exposed through the opening 416*d* and is supported in the developing vessel 416 so as to be rotatable in the direction of arrow R2. The developing roller 411 includes an elastic body and contacts the photosensitive drum 110 at a prescribed contact pressure. Further, a scatter preventing sheet 417 is provided at the opening 416*d* in order to prevent the scattering of toner from below the developing roller 411. The developing roller 411 is a semiconductive resilient roller consisting of a low-hardness rubber material (silicone, urethane, etc.) or foamed body, or a combination thereof, in which an electrical conducting agent (carbon, etc.) has been dispersed.

The stirring member 414, which is rotatable in the direction of arrow R3, is provided at the upper part of the unit opposite the opening 416*d*. A stirring area R is formed inside the developing vessel 416 for stirring and mixing toner inside the developing vessel 416 and toner supplied from the toner supply unit 510. The developing unit 410 is equipped with the toner level sensing unit 415 that uses an optical system comprising a light-emitting unit 415*a*, transmitting windows 415*b* and a photoreceptor 415*c*. The light-emitting unit 415*a* and photoreceptor 415*c* are provided on opposite sides of the stirring area R. The transmitting windows 415*b* are provided in the developing vessel 416 in order to introduce light, which is emitted by the light-emitting unit 415*a*, to the stirring area R and photoreceptor 415*c*. The toner level sensing unit 415 senses the height of the toner level in the stirring area R by measuring the ratio of light-transmission time prevailing when the level of the toner changes with rotation of the stirring member 414. More specifically, when the amount of remaining toner becomes small and the height of the toner level approaches a low level γ, the period of time from the moment the stirring member 414 departs from the optic axis connecting the light-emitting unit 415*a* and photoreceptor 415*c* owing to rotation in the clockwise direction to the moment the stirring member 414 interrupts the optic axis again lengthens (a time period during which the photoreceptor 415*c* can detect light lengthens). Conversely, when the remaining amount of toner is in the vicinity of a high level δ, the time during which light can be detected by the photoreceptor 415*c* is short, even if the stirring member 414 is rotated in the clockwise direction. Thus, it is possible to detect the height of the toner level by the toner level sensing unit 415.

Further, the supply roller 413 for supplying and recovering developer is placed below the stirring area R so as to contact the developing roller 411. The supply roller 413 is a resilient roller comprising a resilient foam body and rotates in a direction opposite that of the developing roller 411 at the point of contact. By virtue of this arrangement, the developer is stirred fully in the stirring area R by the stirring member 414, subsequently migrates through the opening 416*c* mainly under the force of gravity and is supplied to the developing roller 411 by the supply roller 413.

The blade 412 serving as a regulating member to regulate the layer thickness of the developer is provided on the developing vessel 416 so as to apply pressure to the developing roller 411. The blade 412 is a resilient regulating member obtained by providing a leaf-spring-type thin metal plate 412*b* with an insulating layer 412*a* on the surface of the plate that contacts the developing roller 411. As a result, toner that has been supplied to the developing roller 411 has its layer thickness regulated by the blade 412 and is applied to the developing roller 411 so that a thin layer of the toner is formed thereon. Furthermore, enough electric charge for use in development is applied to the toner owing to friction between the developing roller 411 and blade 412. The thin layer of toner on the developing roller 411 is subsequently transported with rotation of the developing roller 411 to a developing area (a developing nip) where the photosensitive drum 110 and developing roller 411 are in contact. The developer (toner) takes part in development in a state in which it is in contact with the photosensitive drum 110. That is, a power supply (not shown) is connected in order to form a developing electric field between the photosensitive drum 110 and developing roller 411. As a result, the toner on the developing roller 411 is shifted to the photosensitive drum 110 by the action of the developing electric field, a toner image is formed in conformity with the electrostatic latent image on the surface of the photosensitive drum 110 and the electrostatic latent image is visualized.

Further, the toner coats the developing roller 411 and is carried and transported to the developing nip. However, toner that has not contributed to development and that remains on the developing roller 411 is wiped off the developing roller 411 owing to sliding contact with the supply roller 413. Some of the toner thus wiped off is subsequently supplied to the developing roller 411 again by the supply roller 413 together with toner newly supplied to the supply roller 413. The remaining toner is returned to the developing vessel 416.

According to the first embodiment, the supply roller 413 performs two functions, namely supply and recovery of the developer. However, the first embodiment is not limited to this arrangement and it is possible to provide developer supply means and developer recovery means separately.

The process speed of the image forming apparatus according to the first embodiment is 150 mm/s, while the circumferential speed of the developing roller 411 is 225 mm/s.

Further, the developing unit 410 is adapted so as to be removably installed in the image forming apparatus and is replaced when it reaches the end of its service life (i.e., when 30,000 pages of size A4 paper have been printed in the example of this embodiment).

On the basis of toner-level height information obtained from the toner level sensing unit 415, a controller (see FIG. 3) provided in this image forming apparatus controls the amount of toner supplied from the toner supply unit 510 in such a manner that the height of the toner level will be maintained in a range from the lower end, in the vertical direction, of the range of movement of stirring member 414 to a point at a height less than that of the vessel wall defining the top side of the developing vessel 416 (the fixed range is from γ to δ in FIG. 2).

A CPU or dedicated electric circuit, for example, can be used as the controller. The vessel wall defining the top side of the developing unit 410 refers to that part of the inner wall of developing vessel 416 situated at the highest location.

A stirring member 514 for smoothing out the toner inside the toner supply unit 510 and the supply roller 513 for supplying toner from the toner supply unit 510 to the developing unit 410 are placed inside the toner supply unit 510. In response to a supply command from the developing unit 410, the supply roller 513 supplies the developing unit 410 with a fixed amount of toner per prescribed driving time.

Detection of amount of toner and the toner supply operation will be described next.

In the first embodiment, the toner level sensing unit 415 is capable of sensing at least two heights (γ and δ in the embodiment, as illustrated in FIG. 2) of the toner level.

A controller 300 (FIG. 3) provided in the image forming apparatus of the first embodiment issues a toner supply command to rotate the supply roller 513 at a fixed speed when the height of the toner level changes owing to an image forming operation and the toner level sensing unit 415 senses the lower level γ of the two toner levels (γ and δ) of toner height. As a result, the toner supply unit 510 supplies toner in a predetermined fixed amount per unit time. Further, when the toner level sensing unit 415 senses the higher level δ of the two toner levels (γ and δ) of toner height owing to continuous supply of the toner from the toner supply unit 510, the controller 300 halts the toner supply command, thereby halting the rotation of the supply roller 513 and stopping the supply of toner from the toner supply unit 510.

As a result, the controller 300 exercises control in such a manner that the height of the toner level in the developing vessel 416 will be maintained in a range from the lower end, in the vertical direction, of the range of movement of stirring member 414 to a point at a height less than that of the vessel wall defining the top side of the developing vessel 416 (the fixed range from γ to δ in FIG. 2).

In the first embodiment, γ is set to a position higher than the center of the range of movement of the stirring member 414, and δ is set to a position lower than the upper end, in the vertical direction, of the range of movement of the stirring member 414. Further, the supply roller 513 is placed vertically above the stirring area R, and it is so arranged that the toner supplied by rotation of the supply roller 513 will pass through the stirring area R in reliable fashion.

Further, after the supplied toner has been stirred and mixed thoroughly, the toner, because of the positional relationship among the stirring area R, supply roller 413 and blade 412, is supplied slowly to the vicinity of the supply roller 413 owing to consumption of the toner by image formation and movement of the toner mainly under the force of gravity. As a result, the supplied toner will not be fed to the developing roller 411 in a state in which it has not been mixed thoroughly with the toner inside the developing unit 410, and therefore the occurrence of density unevenness, fogging and excessive toner build-up can be prevented.

Further, since the height of the toner level in the stirring area R is controlled so as not to touch the vessel wall defining the top side of the developing vessel 416, toner will not completely fill up the interior of the developing vessel 416 owing to excessive supply of toner and toner pressure will not rise. This makes it possible to prevent the occurrence of problems such as accelerated toner degradation, toner leakage and higher driving torque ascribable to a rise in toner pressure, as well as density unevenness caused by non-uniform toner coating ascribable to a rise in toner pressure.

Figure 3:
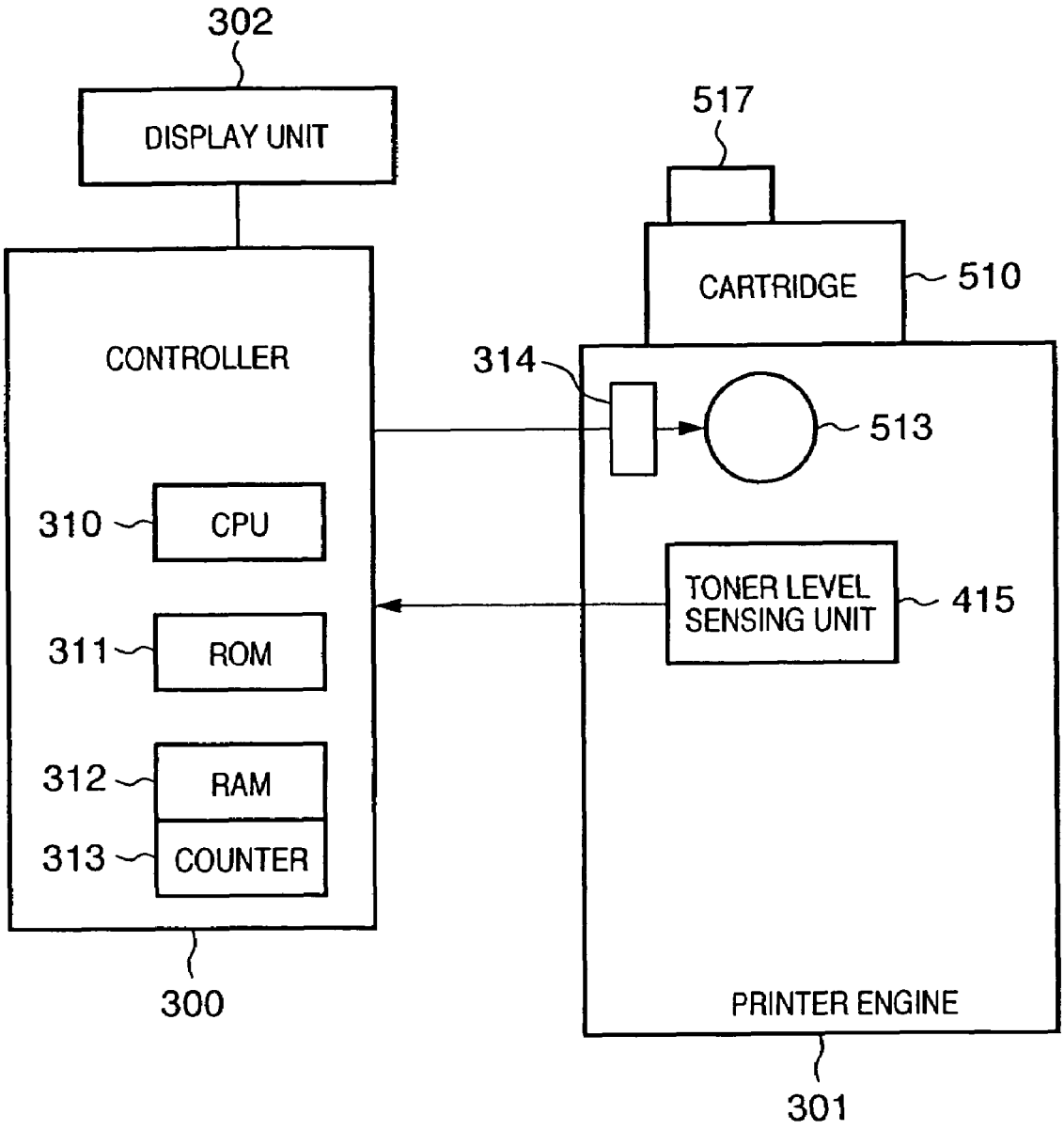
FIG. 3 is a block diagram illustrating the structure of the image forming apparatus according to this embodiment.

FIG. 3 is a block diagram illustrating the structure of the image forming apparatus according to this embodiment, in which components identical with those appearing in the foregoing drawings are designated by like reference characters.

The controller 300 in FIG. 3 controls the entire image forming apparatus. A printer engine 301, which has the structure shown in FIG. 1, forms an image on a printing paper P by electrophotography. A display unit 302 is provided on, e.g., a control panel and is used to present the user with an indication of messages and errors. It is also used to present a display of remaining amount of toner, an advance notice to replace the toner cartridge (the toner supply unit 510) and a request to replace the toner cartridge, etc., as will be described later. The controller 300 has a CPU 310 such as a microprocessor, a ROM 311 storing programs executed by the CPU 310, various tables and data, etc., and a RAM 312, which is used as a work area when control processing by the CPU 310 is actually executed, for storing various tables temporarily.

Further, in a case where toner is supplied from the toner supply unit 510, the controller 300 outputs a drive signal to a drive unit 314 based upon a detection signal from the toner level sensing unit 415, and the supply roller 513 is rotated a prescribed amount by the drive unit 314 based upon the drive signal.

Figure 4:
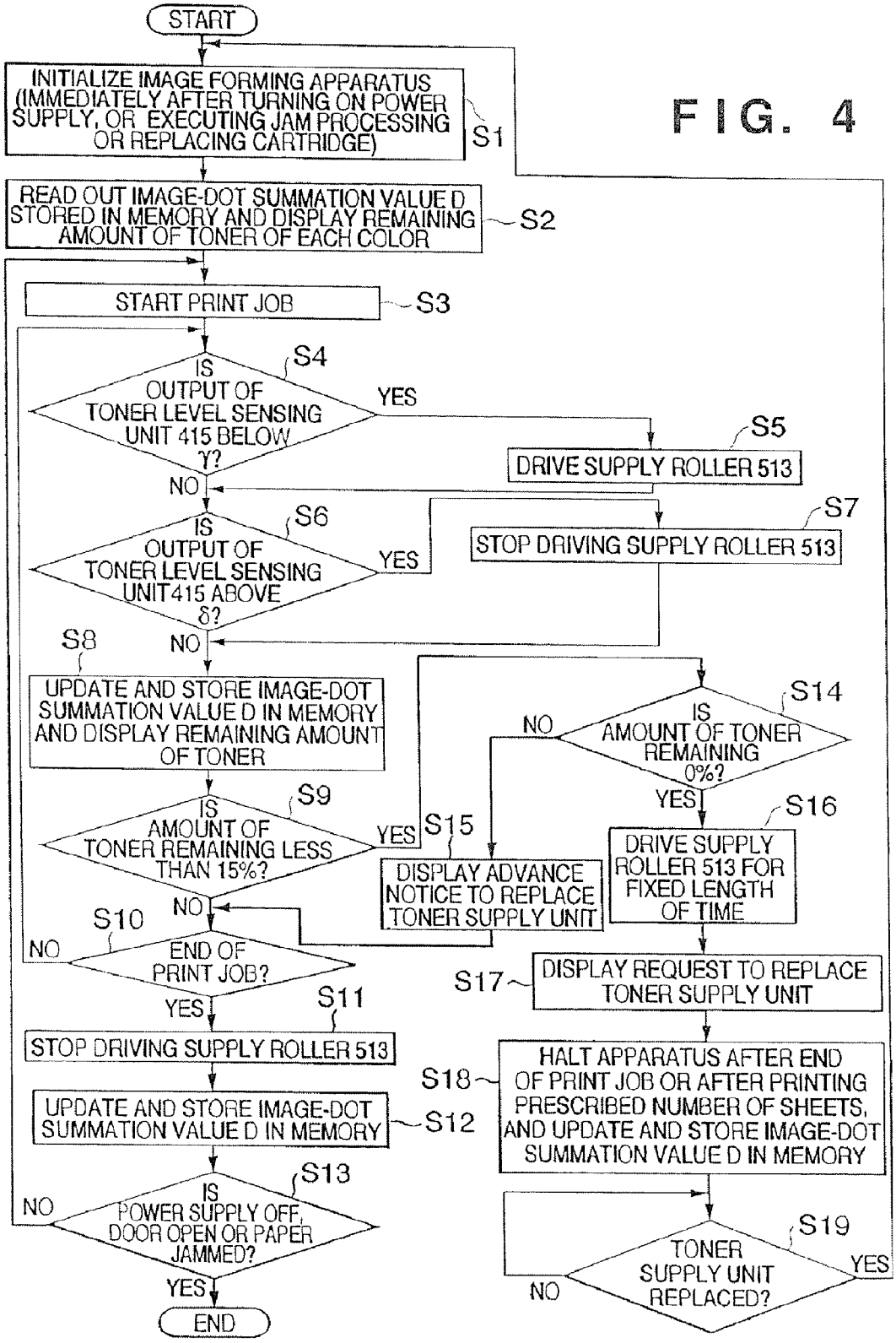
FIG. 4 is a flowchart for describing processing executed in the image forming apparatus according to the first embodiment of the present invention.

Reference will now be had to the flowchart of FIG. 4 to describe processing in the image forming apparatus according to this embodiment, namely sensing of remaining amount of toner in the toner supply unit 510, display of remaining amount of toner, advance notice to replace the toner cartridge, issuance of a request to replace the toner cartridge and processing for issuing a request to exchange the toner cartridge. The program for executing this processing is stored in the ROM 311 and is run under the control of the CPU 310.

The amount of toner remaining in the toner supply unit 510 is found by adding up, as an image-dot summation value D, the number of dots formed from the start of use of the toner supply unit 510, estimating the amount of consumed toner based upon the summation value D and a relationship (image-dot summation value D vs. amount of toner supplied) obtained in advance by experimentation, and comparing the amount of toner that initially filled the toner supply unit 510 and the estimate amount of consumed toner. Further, the image-dot summation value D is also stored in an EEPROM 517, which serves as storage means attached to the toner supply unit 510. As a result, even if the toner supply unit 510 is removed during the course of use and is used upon being installed in another image forming apparatus, the amount of toner remaining in the unit can be detected accurately.

This processing is started when the power supply of the image forming apparatus is turned on or in response to recovery from error such as paper jamming or replacement of the toner supply unit 510. The image forming apparatus is initialized at step S1. Next, at step S2, the summation value D of number of image dots formed by the toner supply unit 510 is read out of the memory (EEPROM) 517 provided on the toner supply unit 510, and this value is compared with the initial amount of toner (stored in EEPROM 517, e.g., indicated in terms of number of dots to be formed by the initial amount of toner) that filled the toner supply unit 510, whereby the remaining amount of toner in the toner supply unit 510 is found and displayed as a percentage on the display unit 302.

Next, when a print job starts at step S3 in response to a print command from a host computer (not shown) or the like, control proceeds to step S4. Here it is determined whether the height of the toner level sensed by the toner level sensing unit 415 is below the lower level γ described above. If the decision rendered is "YES", then control proceeds to step S5, where rotative drive of the supply roller 513 is started to cause toner to move from the toner supply unit 510 to the interior of the developing vessel 416. It is determined at step S6 whether the height of the toner level sensed by the toner level sensing unit 415 is above the higher level δ described above. If the decision rendered is "YES", control proceeds to step S7, at which the rotative drive of the supply roller 513 is halted (if the supply roller 513 is already at rest, the supply roller 513 is maintained in the halted state) to stop the supply of toner from the toner supply unit 510. During the printing operation, the number of dots formed is monitored and this is added to the image-dot summation value D, which has been read out of the EEPROM 517 of the toner supply unit 510, at step S8. It should be noted that the image-dot summation value D prevailing during execution of a print job is calculated using a counter 313 of the RAM 312. It may be so arranged that the EEPROM 517 is updated at the moment the print job is completed or at the moment an error such as jamming occurs. This makes it possible to reduce the number of times the EEPROM 517 is accessed.

Next, at step S9, it is determined whether the amount of toner remaining in the toner supply unit 510 is less than 15%. If the decision rendered is "NO", control proceeds to step S10, at which it is determined whether execution of the print job has ended. If it has not ended, control returns to step S4 and the above-described processing is repeated from step S4 onward. If it is found at step S10 that the print job has ended, then control proceeds to step S11, at which rotative drive of the supply roller 513 is halted (if the supply roller 513 is already at rest, then the supply roller 513 is maintained in the halted state). Then, at step S12, the image-dot summation value D is stored in the EEPROM 517. Next, control proceeds to step S13. Here it is determined whether the power supply has been turned off or whether an error such as jamming has occurred, etc. If the decision rendered is "YES", then processing is exited; otherwise, control returns to step S3.

If the amount of toner remaining is found to be less than 15% at step S9, control proceeds to step S14, at which it is determined whether the amount of toner remaining in the toner supply unit 510 has become 0%. If the decision is "NO", control proceeds to step S15. Here the controller 300 outputs information, which indicates that the remaining amount of toner is less than a prescribed amount, to the display unit 302, whereby advance notice to exchange the toner supply unit 510 (advance notice to the effect that the remaining amount of toner is less than a prescribed amount) is displayed on the display unit 302 to notify the user. Control then proceeds to step S10.

When it is found at step S14 that the amount of toner remaining in the toner supply unit 510 is 0%, control proceeds to step S16. Here, before a request to exchange the toner supply unit 510 is sent, the supply roller 513 is forcibly rotated just long enough to supply a fixed amount of toner (described later). The reason for this is as follows: In a case where the remaining amount of toner is estimated from the relationship (image-dot summation value D vs. amount of toner supplied) found by experimentation, a slight difference develops between the estimated value and the actual amount of toner remaining. Accordingly, it is conceivable that at the moment the remaining amount of toner is judged to be 0% based upon the image-dot summation value D, a certain amount of toner will still remain in the toner supply unit 510 in certain cases owing to variance and the like. This means that if a request to replace the toner supply unit 510 is displayed immediately at the moment it is estimated that the amount of toner remaining in the toner supply unit 510 is 0%, there is a possibility that the toner supply unit 510 will be replaced despite the fact that a slight amount of toner remains in the toner supply unit 510 and that the toner remaining in the unit will be wasted as a result. At step S16, therefore, even if the maximum amount of toner that can result from variance remains, the supply roller 513 is forcibly rotated just long enough to enable this remaining toner to be positively supplied to the developing vessel 416, thereby causing the toner remaining in the toner supply unit 510 to migrate to the developing vessel 416 completely. The length of this period of time for forcibly rotating the supply roller 513 is several minutes or less. Under conditions of actual use, the time required is substantially the same as that in a case where the remaining amount of toner actually becomes 0%. The user, therefore, does not sense anything unusual.

In this embodiment, the forcible rotative drive of the supply roller 513 is inserted temporarily during the course of a printing operation as an operating sequence separate from the printing operation. This forcible rotative drive of the supply roller 513 may be performed during an actual printing operation. Alternatively, the forcible rotative drive of the supply roller 513 may be performed during a printing operation while a print job is continuing and, if it is necessary to continue forcible rotation following the end of the print job, this rotative drive may be continued as a separate operating routine.

Control proceeds to step S17, at which information from the controller 300 indicating that no toner remains is output to the display unit 302. In response, a request to replace the toner supply unit 510 is displayed on the display unit 302 to notify the user. Next, if the present print job has ended or if image formation (printing) in excess of a fixed number of sheets has been executed continuously, the printing operation is halted temporarily at step S18. The image forming operation is inhibited until the user replaces the toner supply unit 510 at step S19. Further, at step S18, the image-dot summation value D calculated thus far is stored in the EEPROM 517 of toner supply unit 510 in concurrence with the halting of the printing operation, thereby updating the value D. When it is determined at step S19 that the toner supply unit 510 has been replaced, control returns to step Si and the above-described processing is repeated.

The toner supply unit 510 in the first embodiment initially accommodates about 300 g of toner. The apparatus is set up so that images having a printing area ratio of 5% can be printed (formed) on approximately 10,000 sheets of paper with this amount of toner. In a case where the remaining amount of toner was estimated from the relationship (image-dot summation value D vs. amount of toner supplied) found by experimentation as described above, there was an instance where at maximum an amount of toner of 30 g remained at the moment the remaining amount of toner was estimated to be 0%. [In the first embodiment, a plurality of relationships between the image-dot summation value D and amount of supplied toner were measured and the relationship that gave the largest amount of supplied toner based upon the result of these measurements was set as the relationship (image-dot summation value D vs. amount of toner supplied) used. Accordingly, it is so arranged that variance occurs only in a case where toner remains (i.e., so that the estimated amount of toner remaining will never be less than the actual amount of toner remaining)]

On the basis of information concerning toner-level height in the stirring area R obtained from the toner level sensing unit 415, the developing unit 410 of the first embodiment is controlled in such a manner that the height of the toner level will be maintained in a fixed range (allowable range) within a range (γ to δ) from the lower end, in the vertical direction, of the range of movement of stirring member 414 to a point at a height less than that of the vessel wall defining the top side of the developing vessel 416, as described above. The length from the higher level δ of the toner level to the top side of the developing vessel 416 is set so that a further 50 g of toner can be accommodated. As a result, even though a maximum of 30 g of toner ascribable to variance is forcibly supplied to the developing vessel 416 in a case where the remaining amount of toner in the toner supply unit 510 has been sensed to be 0%, the toner will not overflow from the developing unit 410. As a result, the set-up is such that impediments such as toner degradation, which is due to pressure built-up, and toner leakage that might result from the increase in amount of toner inside the developing vessel 416, will not occur.

Further, according to the arrangement of the first embodiment, the forcible supply of 30 g of toner from the toner supply unit 510 to the developing unit 410 requires a little less than about two minutes. When printing is performed conventionally on size A4 paper at a printing area ratio of 5% using this amount of toner, printing equivalent to about 1000 sheets of paper can be performed. This means that a maximum of about 1000 sheets of paper can be printed on from the moment absence of toner is estimated to the moment toner actually runs out. The user thus is given considerable leeway from the moment absence of toner is displayed to the moment toner is actually depleted and might judge that the absence-of-toner display is unreliable. In accordance with the first embodiment, however, absence of toner is displayed after (approximately two minutes after) toner of the largest amount that can possibly remain in the toner supply unit 510 is supplied to the developing unit 410. At the moment the absence-of-toner display is presented, therefore, the actual amount of toner in the toner supply unit 510 is positively "0" and, hence, the user can rely upon the absence-of-toner display.

In the image forming apparatus according to the first embodiment, the request to replace the toner supply unit 510 is issued to the user. When the toner supply unit 510 has been exchanged, the apparatus returns to a state in which image formation is possible and waits for a print request from the user. When the toner supply unit 510 is exchanged for another, toner in an amount forcibly supplied the last time will remain in the developing unit 410. Therefore, until the toner-level height obtained from the toner level sensing unit 415 in the developing unit 410 is sensed to be at the γ level, the operation for supplying toner from the replacement toner supply unit 510 is not carried out. Further, in the image forming apparatus of this embodiment, the sensing of remaining amount of toner in the toner supply unit 510 is performed by inference from the image-dot summation value D from start of use of the toner supply unit 510. Accordingly, the toner level sensing unit 415 inside the developing unit 410 starts sensing use of the toner (starts adding up the number of printed image dots) when the lower level γ is sensed and the toner supply operation starts.

By virtue of the arrangement described above, a change in remaining amount of toner conforming to degree of use by the user can be reported without providing the toner supply unit 510 with a device for sensing remaining amount of toner.

Further, a warning to exchange a toner cartridge because of absence of toner and a request to exchange the toner cartridge can be reported at appropriate timings.

Further, when the toner supply unit 510 is replaced, all of the toner in the toner supply unit 510 can be used up. That is, after notification is given of the fact that the remaining amount of toner is small, the timing at which toner runs out no longer occurs earlier or later than predicted. Further, a problem wherein toner is left inside the toner supply unit 510 even though replacement is performed at an appropriate timing, thereby resulting in replacement that is unnecessary, does not arise.

Furthermore, with the image forming apparatus according to this embodiment, impediments such as fogging and toner leakage are eliminated by such control.

Further, according to the first embodiment, the toner level sensing unit 415 employs an optical system, although a piezoelectric oscillating sensor may be used. Further, as sensing means capable of determining whether a toner level of a fixed height is within a prescribed range, it is possible to substitute any sensing device such as a strain gauge or pressurized electrically conductive sheet or sensing means such as one that relies upon an electrostatic antenna.

Further, according to this embodiment, a pixel (dot) counting method of measuring the number of pixels (dots) of a printed image and summing the number is adopted as means for sensing the amount of toner remaining in the toner supply unit 510. However, other methods that may be employed include a method of estimating amount of toner consumption based upon a method of integrating amount of light emitted from exposure means such as a laser or LED, a method of adding up amount of drive of toner supply means, namely number of revolutions of the toner supply roller, and a method in which, if the amount of toner per fixed amount of drive supplied from toner supply means such as a toner supply roller varies owing to the remaining amount of toner in the toner supply unit 510, the amount of drive of the toner supply means is sequentially calculated in terms of amount of supplied toner based upon this corresponding relationship, and the amount of toner supplied is added up. Further, even in a case where various sensing schemes introduced as toner-level sensing means are provided separately as means for sensing amount of toner in the toner supply unit, the cost-related advantage of not specially providing the toner supply unit 510 with toner-quantity sensing means cannot be enjoyed but, by implementing control according to this embodiment, it is possible ultimately to obtain effects similar to those of the first embodiment, namely the fact that the issuance of the request to exchange the toner supply unit 510 can be performed at an appropriate timing and in a state in which all of the toner has been used up.

According to the first embodiment, the EEPROM 517 serving as storage means is mounted on the toner supply unit 510 and therefore the remaining amount of toner can be reported accurately even if the toner supply unit 510 is extracted in the course of use. However, by taking suitable measures such as preventing replacement of the toner supply unit during usage and providing the storage means itself on the main body of the image forming apparatus, the cost of the toner supply unit 510 can be reduced.

SECOND EMBODIMENT

A second embodiment of the present invention will now be described.

In comparison with the first embodiment, the second embodiment is characterized in that (1) the developing unit is constructed by integrating the photosensitive drum, charge roller and cleaner unit and is adopted as a process cartridge that is capable of being replaced in the image forming apparatus when the end of its prescribed service life ends; (2) the image forming apparatus is an in-line full-color image forming apparatus in which process cartridges of the four colors yellow (Y), cyan (C), magenta (M) and black (K) are arranged in a single row to form a color image; and (3) the method of estimating amount of toner remaining in the toner supply unit and the method of controlling the halting of the image forming apparatus when replacement of the toner supply unit is requested differ.

Figure 5:
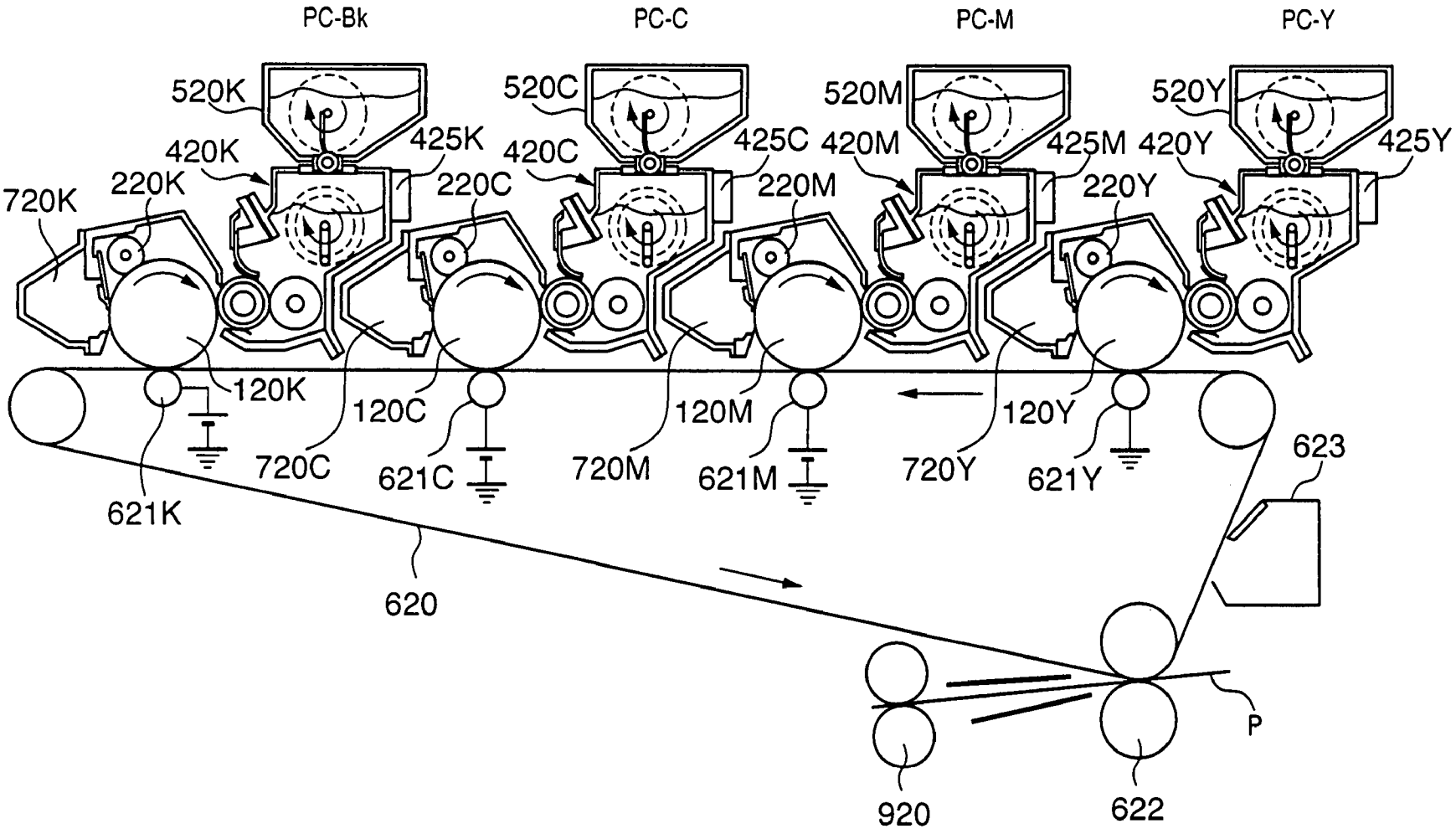
FIG. 5 depicts a sectional view illustrating the structure of the image forming section of an image forming apparatus according to a second embodiment of the present invention.

FIG. 5 is a diagram illustrating the structure of the image forming section of the image forming apparatus according to the second embodiment of the present invention. This image forming apparatus is a full-color laser printer provided with an intermediate transfer body 620 serving as a second image carrier for forming a full-color image by transferring and superimposing the toner images of each of the colors that have been formed on the photosensitive drums corresponding to respective ones of the colors.

Developing units 420 (Y, M, C, K) of a configuration similar to that of the developing unit in the first embodiment constitute process cartridges PC in which respective ones of photosensitive drums 120 (Y, M, C, K), charge rollers 220 (Y, M, C, K) and cleaner units 720 (Y, M, C, K) are integrally accommodated. Each process cartridge is adapted so as to be replaceable in the image forming apparatus when it has reached the end of its service life. Further, the image forming apparatus is equipped with four process cartridges PC (Y, M, C, K) removably installed in the main body of the image forming apparatus and containing toners of the four colors of yellow (Y), cyan (C), magenta (M) and black (K), respectively (the process cartridge for the color black is indicated by PC-Bk in FIG. 6). The structure and operation, etc., of the photosensitive drum, developing roller and charge roller, etc., inside the process cartridges PC (Y, M, C, K) are the same as those of the first embodiment and need not be described again.

In FIG. 5, reference characters 425Y to 425K represent toner-level sensing units corresponding to toners of respective ones of the colors, and reference characters 520Y to 520K represent toner supply units corresponding to respective ones of the colors. Further, reference characters 621Y to 621K represent primary transfer rollers for transferring the toner images on the photosensitive drums inside the process cartridges of the respective colors to the intermediate transfer body 620, and rollers 622 are secondary transfer rollers for transferring the full-color image on the intermediate transfer body 620 to a sheet of printing paper P. A cleaning unit 623 removes and recovers residual toner on the intermediate transfer body 620.

Figure 6:
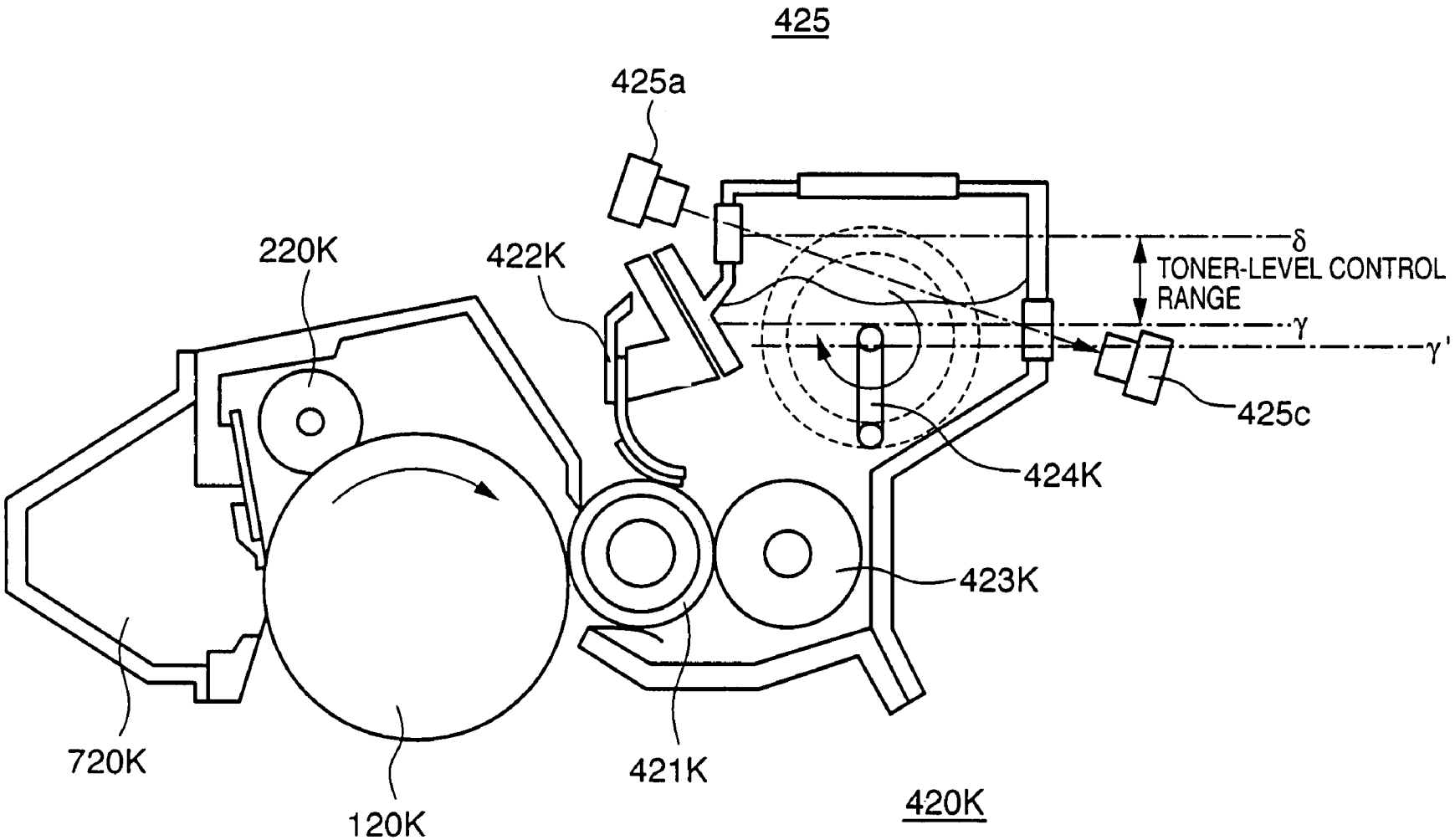
FIG. 6 depicts a sectional view of a black process cartridge according to the second embodiment of the present invention.

FIG. 6 depicts a sectional view showing the structure of the process cartridge PC-Bk for the color black. Although only the process cartridge for black is shown here, the structure of the process cartridges for the other colors is basically the same and therefore these other process cartridges need not be described.

In FIG. 6, the surface of the photosensitive drum 120K is charged uniformly by the charge roller 220K and an electrostatic latent image conforming to an image signal is formed on the charge surface by an emitted laser beam. The supply roller 423K that supplies and recovers toner is disposed in contact with the developing roller 421K. Toner in the stirring area is supplied to the developing roller 421K by the supply roller 423K. The black toner that has been supplied to the developing roller 421K has its layer thickness regulated by a blade 422K and a thin layer of the toner coats and is formed on the developing roller 421K. Thus, a black toner image conforming to the electrostatic latent image is formed on the surface of the photosensitive drum 120K. The toner level sensing unit 425 has a light-emitting unit 425*a* and a photoreceptor 425*c*. In a manner similar to that of the toner level sensing unit 415 according to the first embodiment, the toner level sensing unit 425 senses the height of the black toner level in the stirring area. A stirring member 424K stirs the toner in the stirring area.

This arrangement is similar also in the case of the process cartridges for the other color toners.

The toner images that have been formed on the surfaces of the photosensitive drums 120 corresponding to respective ones of the colors are transferred and superimposed as color toner images on the intermediate transfer body 620 in accordance with the order of placement of the process cartridges (Y, M, C, Bk) of the colors yellow, magenta, cyan and black. The resulting color toner image on the intermediate transfer body 620 is transferred to the printing paper P transported by feed rollers 920, then the image to the printing paper P is fixed by heating and pressure applied by a fixing unit (not shown). The paper is ejected with a full-color image printed thereon.

Figure 7:
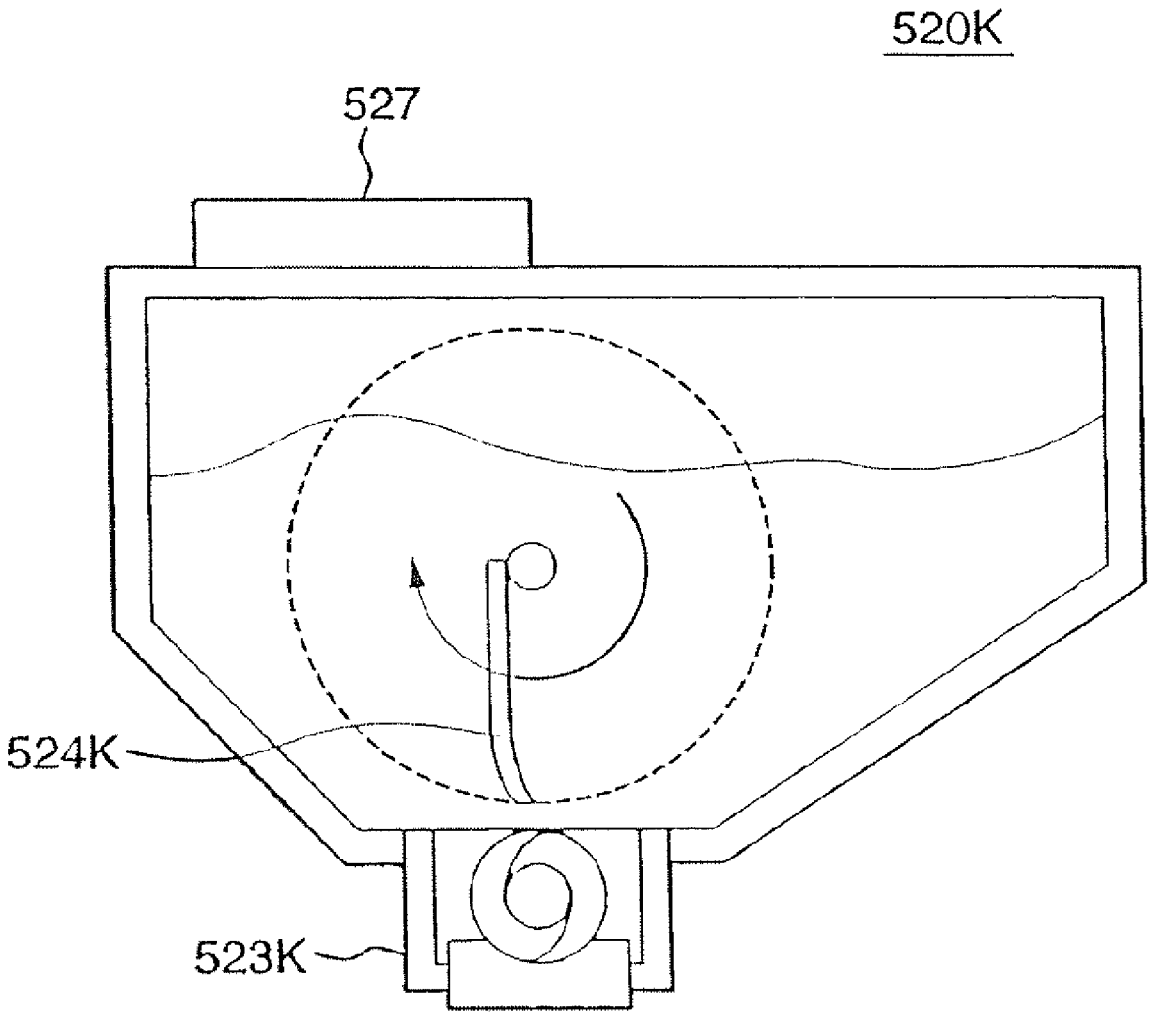
FIG. 7 is a diagram illustrating the structure of a toner supply unit for black toner according to the second embodiment of the present invention.

FIG. 7 is a diagram illustrating the structure of the toner supply unit 520K for black toner. The toner supply unit 520 (Y, M, C, K) is removably provided in the image forming apparatus in a manner similar to that of the first embodiment described above.

A stirring member 524K for smoothing out the black toner of the toner supply unit 520K and a supply screw 523K for supplying toner from the toner supply unit 520K to the developing unit 420K (FIG. 6) are disposed inside the toner supply unit 520K shown in FIG. 7. In response to a supply command from the controller 300 (FIG. 3), the supply screw 523K causes the black toner to migrate to a supply port at one end of the toner supply unit 520K in the longitudinal direction thereof and supplies the toner to the developing unit 420K. The toner supply units 520 (Y, M, C, K) of the respective colors are similarly constructed and have EEPROMs 527 (Y, M, C, K), respectively, serving as storage means. The number of revolutions of the supply screw 523K from the start of use of the toner supply unit 520K is added up and stored in the EEPROM 527K of FIG. 7. The same is true with regard to the EEPROMs 527 (Y, M, C) corresponding to the other colors. This image forming apparatus estimates the remaining amount of toner in the toner supply unit 520 of each color based upon a summed number of revolutions S of the supply screw 523 from start of use of toner supply unit 520 of each color and amount of toner that filled the unit initially.

Figure 8:
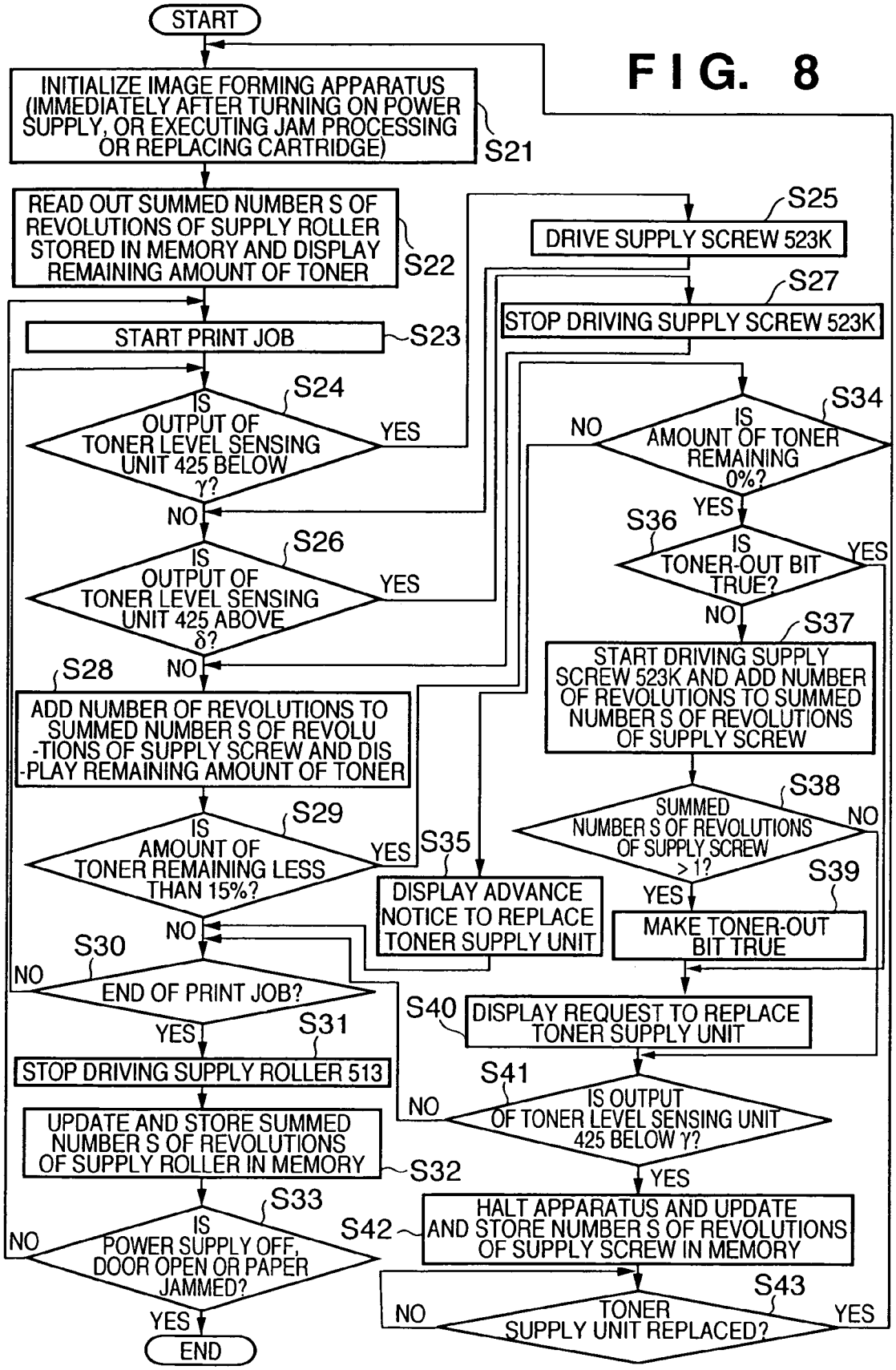
FIG. 8 is a flowchart for describing processing executed in the image forming apparatus according to the second embodiment of the present invention.

FIG. 8 is a flowchart for describing processing in the image forming apparatus according to the second embodiment of the present invention. The structure of the image forming apparatus according to the second embodiment basically is the same as the structure shown in FIG. 3 described above. The second embodiment differs from the first embodiment in that the printer engine 301 has the image forming section of the kind illustrated in FIG. 5.

Reference will now be had to the flowchart of FIG. 8 to describe processing in the image forming apparatus according to this embodiment, namely sensing of remaining amount of toner in the toner supply unit 520, display of remaining amount of toner, advance notice to replace the toner cartridge, issuance of a request to replace the toner cartridge and processing for issuing a request to exchange the toner cartridge. The program for executing this processing is stored in the ROM 311 and is implemented under the control of the CPU 310. It should be noted that this flowchart describes processing executed in the image forming sections of respective ones of the colors Y, M, C and Bk. In the actual apparatus, processing indicated by this flowchart is executed for every image forming section color by color.

The amount of toner remaining in the toner supply unit 520 is found by adding up the number of revolutions of the supply screw 523 of toner supply unit 520, storing the summation value S of the number of revolutions in the EEPROM 527 serving as storage means attached to the toner supply unit 520, estimating the amount of consumed toner based upon the summation value S and a relationship (summed number of revolutions S of the supply screw vs. amount of toner supplied) obtained in advance by experimentation, and comparing the amount of toner that initially filled the toner supply unit and the estimate amount of consumed toner.

This processing is started when the power supply of the image forming apparatus is turned on or in response to recovery from error such as paper jamming or replacement of the toner supply unit 520. The image forming apparatus is initialized at step S21. Next, at step S22, the summed number of revolutions S of the supply screw in the toner supply unit 520 is read out of the memory (EEPROM) 527 provided on the toner supply unit 520 of each color, and this value is compared with the initial amount of toner (stored in EEPROM 527) that filled each toner supply unit 520, whereby the remaining amount of toner in the toner supply unit 520 of each color is found and displayed as a percentage on the display unit 302.

Next, when a print job starts at step S23 in response to a print command from a host computer (not shown) or the like, control proceeds to step S24. Here based upon the height of the toner level sensed by the toner level sensing unit 425 of each process cartridge (PC), it is determined whether there is a process cartridge for which the height of the toner level is below the lower level γ described above. If the decision rendered is "YES", then control proceeds to step S25, where rotative drive of the supply screw 523 of this process cartridge is started to cause toner to move from the toner supply unit 520 to the interior of the developing vessel developing unit 420. Next, at step S26, based upon the height of the toner level sensed by the toner level sensing unit 425 of each process cartridge, it is determined whether there is a process cartridge for which the height of the toner level is above the higher level δ described above. If the decision rendered is "YES", control proceeds to step S27, at which rotative drive of the supply screw 523 of this process cartridge is halted (if the supply screw 523 is already at rest, then the supply screw 523 is maintained in the halted state) to stop the supply of toner from the toner supply unit 520. During the printing operation, the summed number of revolutions S of the supply screw 523 in each process cartridge is obtained at step S28 and this is added to the summed number S of revolutions of the supply screw that has been read out of the EEPROM 517 of the toner supply unit 520 of each process cartridge. It should be noted that the summation value S prevailing during execution of a print job is obtained by adding up the number of revolutions of the supply screw 523 corresponding to each color using the counter 313 of the RAM 312. It may be so arranged that the content of the corresponding EEPROM 527 is updated at the moment the print job is completed or at the moment an error such as jamming occurs. This makes it possible to reduce the number of times each EEPROM 527 is accessed.

Next, at step S29, it is determined whether there is a toner supply unit 520 for which the amount of remaining toner is less than 15%. If the decision rendered is "NO", control proceeds to step S30, at which it is determined whether execution of the print job has ended. If it has not ended, control returns to step S24 and the above-described processing is repeated from step S24 onward. If it is found at step S30 that the print job has ended, then control proceeds to step S31, at which the rotative drive of the supply roller 523 is halted (if the roller is already at rest, then the roller is maintained in the halted state). Next, at step S32, the summed number of revolutions S of the supply screw 523 corresponding to the process cartridge of each color is stored in the corresponding EEPROM 517 and control proceeds to step S33. Here it is determined whether the power supply has been turned off or whether an error such as jamming has occurred, etc. If the decision rendered is "YES", then processing is exited; otherwise, control returns to step S23.

If a toner supply unit 520 for which the amount of toner remaining is less than 15% has been found at step S29, control proceeds to step S34, at which it is determined whether the amount of toner remaining in this toner supply unit 520 has become 0%. If the decision is "NO", control proceeds to step S35. Here the controller 300 outputs information, which indicates that the remaining amount of toner is less than a prescribed amount, to the display unit 302, whereby advance notice to exchange this toner supply unit 520 is displayed on the display unit 302 to notify the user. Control then proceeds to step S30.

When it is found at step S34 that the amount of toner remaining in this toner supply unit 520 is 0% , control proceeds to step S36, where it is determined whether a toner-out bit is true. That is, it is determined whether the forcible rotative drive of the supply screw 523 of the process cartridge has been completed. If it has been completed, then control proceeds to step S40, where the controller 300 sends the display unit 302 information indicating that this toner supply unit 520 is out of toner. As a result, a message requesting replacement of the toner supply unit 520 is displayed on the display unit 302. When it is found at step 536 that forcible rotative drive of the supply screw 523 has not been completed, then control proceeds to step S37. Here rotative drive of the supply screw 523 is started and the number of revolutions S of the supply screw. Next, at step S38, it is determined whether the supply screw 523 has been rotatively driven enough to supply a fixed amount of toner, described later. That is, it is determined whether the summed number of revolutions S of the supply screw is greater than a predetermined threshold value L (a value obtained by adding the number of revolutions to supply a fixed amount of toner described later, to a number of revolutions for which the remaining amount of toner becomes 0%). The reason for this is as follows: In a case where the remaining amount of toner in the toner supply unit 520 is estimated based upon the relationship (summed number of revolutions S of the supply screw vs. amount of toner supplied) found by experimentation, a slight difference develops between the estimated value and the actual amount of toner remaining. Accordingly, it is conceivable that at the moment the remaining amount of toner is judged to be 0% based upon the summation value S of number of revolutions of the supply screw 523 an amount of toner that is the maximum possible may still remain in certain cases owing to variance and the like. This means that if a request to replace the toner supply unit 520 is issued immediately, there is a possibility that toner will be wasted. Accordingly, the supply screw 523 is forcibly driven into rotation just enough times to supply the maximum amount of toner ascribable to variance to the developing unit 420 as described above, thereby enabling the toner remaining in the toner supply unit 520 to be fed to the developing unit 420 completely. In this embodiment, this number of revolutions of drive ends after about 30 sheets of size A4 paper have been printed, and therefore under conditions of actual use, it is executed at a timing substantially the same as that in a case where the remaining amount of toner of 0% is attained.

In other words, according to this embodiment, toner is forcibly supplied while a printing operation is being executed. If such supply is not carried out and the supply screw 523 is forcibly rotated prescribed times to supply toner in a state in which the printing operation has been temporarily halted, for example, then there is the possibility that the amount of toner inside the developing unit 420 will fluctuate (increase) suddenly. If there is already toner inside the developing unit 420 in this case, the toner will be supplied to the developing roller 411 in a state in which it has not been mixed fully with the newly supplied toner and, hence, there is the danger that the printed image will develop density unevenness, fogging, etc. In order to prevent this, the supply screw 523 is forcibly rotated a prescribed amount to forcibly supply toner while the toner inside the developing unit 420 is consumed during the printing operation.

Particularly, for example, the supply screw 523 is rotated once to supply toner at every time on which one page is printed. The amount of toner supplied in the one rotation of the supply screw 523 is about 0.5 gram so that the toner cartridge becomes empty by discharging the amount (0.5×30=15 gram) of toner at the time that 30 papers have been printed. In the embodiment, the supply screw 523 is rotated predetermined times at which two pages are printed.

It should be noted that this series of operations of rotating the supply screws 523 by a fixed number of revolutions in a case where the remaining amount of toner is determined to be 0% need only be performed once in use of the toner supply units 520 for each of the toners. Following completion of the forcible rotation operation, therefore, the toner-out bit that has been stored in the EEPROM 527 of each toner supply unit 520 is made logical "1" at step S39, thereby storing the fact that this operation has been performed. From the next time onward, it is determined at step S36 whether the toner-out bit is true, i.e., "1". If the bit is "1", then steps S37, S38 and S39 are skipped and the operation of forcibly rotating the supply screw 523 in a case where the remaining amount of toner has been estimated to be 0% is omitted.

At step S40, a request to replace this toner supply unit 520 is issued to the user. Then, at step S41, the output of the toner level sensing unit 425 of the developing unit 420 of this process cartridge is compared and, if it is less than a level γ' (described later) in FIG. 7, the printing operation is halted at step S42 and a request to replace the toner supply unit 520 is issued to the user again. The image forming operation is inhibited until this toner supply unit 520 is replaced. In other cases (i.e., when the output of the toner level sensing unit 425 is not less than the level γ'), the printing operation continues. As a result, the user is notified of absence of toner with the toner depletion rate that prevailed until now being kept substantially intact.

It should be noted that under normal conditions and in concurrence with the halting of the printing operation owing to the remaining amount of toner, the image forming apparatus updates and stores the summed number of revolutions S of the supply screw 523 calculated thus far in the EEPROMs 517 of respective ones of the corresponding toner supply units 520 (steps S32, S42).

The toner supply unit 520 according to the second embodiment also has a structure identical with that of the first embodiment and therefore initially accommodates about 300 g. The apparatus is set up so that images having a printing area ratio of 5% can be printed on approximately 10,000 sheets of paper with this amount of toner. In a case where the amount of toner remaining in the toner supply unit 520 was estimated from the relationship (summed number of revolutions S of the supply screw vs. amount of toner supplied) found by experimentation as described above, there was an instance where at maximum an amount of toner that was 15 g greater than expected remained or an instance where toner ran out before the 15 g of toner was supplied.

In the second embodiment, a plurality of relationships between the summed number of revolutions S of the supply screw 523 and amount of supplied toner were measured and the average value of the results was set as the relationship (supply-screw rpm summation value S vs. amount of toner supplied) used. Accordingly, variance occurs equally both in a case where toner remains and in a case where toner is inadequate. On the basis of information concerning toner-level height obtained from the toner level sensing unit 425, the developing unit of the second embodiment is controlled in such a manner that the height of the toner level will be maintained in a fixed range within a range (γ to δ in FIG. 6) from the lower end, in the vertical direction, of the range of movement of stirring member 414 to a point at a height and less than that of the vessel wall defining the top side of the developing vessel 416, as described above.

The length from the higher level d of the toner level to the top wall of the vessel of the developing unit 420 is set so that a further 30 g of toner can be accommodated. Further, the lower end γ of the control range of the height of the toner level is set at a position higher, by an amount equivalent to 20 g of toner, than an area γ' in which the toner mixing effect is very good. As a result, even though a maximum of 15 g of toner ascribable to variance is forcibly supplied to the developing unit 420 when the remaining amount of toner in the toner supply unit 520 has been sensed to be 0%, the toner will not overflow from the developing unit 420. As a result, the set-up is such that impediments such as toner degradation, which is due to pressure built-up, and toner leakage will not occur.

Further, even in a case where the toner shortfall is 15 g, which is the maximum possible owing to variance, when it has been estimated that the amount of remaining toner is be 0%, fogging, etc., at the time of supply owing to improper stirring of the toner will not occur because the height of the toner level will not fall below the level γ' corresponding to the area in which the toner mixing effect is very good.

Further, even if forcible rotation of the supply screw 523K has not been completed, by checking the output of the toner level sensing unit 425 of developing unit 420 at step S41, the printing operation can be halted at step S42 in a case where the toner level is below the level γ' of FIG. 7. As a result, the toner inside the developing unit will not fall below the level γ'.

Further, according to the arrangement of the second embodiment, the time needed to forcibly supply 15 g of toner is the time needed to print on 30 pages of size A4 paper. When an operation for forcibly supplying toner while a printing operation is being performed is not carried out, as in the prior art, about 500 sheets of paper can be printed on from the moment it is estimated that toner will be absent to the moment toner actually runs out. Consequently, the user, though viewing the display that toner is absent, acquires the impression that it takes a good while for the toner to actually run out. In accordance with the second embodiment, however, the time from the moment it is estimated that toner is absent to the moment absence of toner is actually displayed is short. At the moment the absence-of-toner display is presented, the toner inside the toner supply unit is positively used up and, hence, the situation described above does not occur.

In the image forming apparatus according to the second embodiment, the request to replace the toner supply unit 520 is reported to the user. When the toner supply unit 520 has been exchanged, it is determined that the toner supply unit has been replaced in (Step S43 in FIG. 8), the apparatus returns to a state (Step 521 in FIG. 8) in which image formation is possible and waits for a print request from the user. When the toner supply unit 520 is exchanged for another and the replacement unit is used, toner in an amount forcibly supplied to the developing unit 402 the last time will remain in the developing unit 420. Therefore, until the toner-level height obtained from the toner level sensing unit 425 in the developing unit 420 is sensed to be below at the γ level, the operation for supplying toner is not carried out. The image forming apparatus is such that when the toner level sensing unit 425 inside the developing unit 420 senses that the toner-level height is below the γ level and the toner supply operation is started, the amount of consumed toner starts to be sensed and the number of revolutions of the supply screw 523 starts to be added up.

By virtue of the arrangement described above, a change in remaining amount of toner conforming to degree of use by the user can be reported without specially providing the toner supply unit 520 with a device for sensing remaining amount of toner.

Further, a warning to replace a toner cartridge and a request to replace the toner cartridge can be issued depending upon the actual degree of use of the toner. That is, the time from the moment the user is notified that the remaining amount of toner is small to the moment the amount of toner remaining in the toner supply unit actually becomes zero no longer becomes shorter or longer than predicted.

Further, by issuing the request to replace the toner supply unit 520 to the user, the unit can be replaced in a state in which all of the toner therein has been used up even if the timing at which the user replaces the unit falls within a period from issuance of the request to actual inhibition of printing in the image forming apparatus (i.e., to the moment at which the toner level sensing unit 425 senses that the toner level is below the level γ'). That is, when the toner supply unit 520 is replaced, toner will not remain in the unit and the unit will not be replaced needlessly. Further, with the image forming apparatus according to this embodiment, impediments such as density unevenness, fogging and toner leakage are eliminated by the above-described control.

According to the second embodiment, the EEPROM 527 serving as storage means is mounted on the toner supply unit 520. By updating the content of the EEPROM 527 based upon the image forming operation, the remaining amount of toner can be reported accurately even if the toner supply unit 520 is extracted in the course of use.

Furthermore, it is so arranged that the supply screw 523 is rotatively driven a prescribed number of revolutions in a case where a remaining amount of toner of 0% has been estimated. However, by taking suitable measures such as preventing replacement of the toner supply unit 520 during use, the cost of the toner supply unit can be reduced by providing the storage means on the main body of the image forming apparatus.

In the second embodiment, as described above, the supply screw 523 is rotated in accordance with the level detected by the toner level sensing unit 425. In addition, for example, the number of printed dots may be counted and the number (or time period) of rotations of the supply screw 523 may be calculated in accordance with the counted number and the supply screw 523 may be controlled based on the calculated number (or time period) of rotations. The control can be performed in the embodiment as follows. The number of printed dots in one page is counted during print operation, and the supply screw 523 can be controlled to supply an amount of toner in accordance with the counted number. In this case, the counter 313 counts the number of printed dots and the counted value is stored in the RAM 312, and the CPU 310 calculates the amount of consumed toner based on the stored count value. The CPU 310 calculates the number (or time period) of rotations of the supply screw 523 and controls the rotations of the supply screw 523 base on the calculated number (or time period) of rotations.

The present invention is not limited to the above embodiments and various changes and modifications can be made within the spirit and scope of the present invention. Therefore, to apprise the public of the scope of the invention, the following claims are made.

CLAIM OF PRIORITY

This application claims priority from Japanese Patent Application Nos. 2004-155178 filed on May 25, 2004 and 2005-145883 filed on May 18, 2005, which are hereby incorporated by reference herein.

What is claimed is:

1. An image forming apparatus for forming an image by developing the image by a developing unit using a developer supplied from a replaceable developer supply unit, said apparatus comprising:

driving means for driving into rotation a developer supply roller inside the developer supply unit;

estimating means for estimating an amount of developer remaining inside the developer supply unit;

supply driving means for driving said driving means a prescribed amount in a case where it has been estimated by said estimating means that there is substantially no developer remaining; and output means for outputting information, which indicates that there is no developer remaining inside the developer supply unit, after said supply driving means has driven said driving means.

2. The apparatus according to claim 1, wherein said estimating means includes:

counting means for counting a number of dots of an image that has been formed using said developer supply unit; and arithmetic means for obtaining an amount of consumed developer that corresponds to a count value obtained from said counting means, wherein said estimating means estimates the amount of developer remaining based upon an initial amount of developer in the developer supply unit and the amount of consumed developer as calculated by said arithmetic means.

3. The apparatus according to claim 2, wherein said developer supply unit includes a memory for storing, in a non-volatile fashion, a summation value of the number of dots that has been counted by said counting means, and said arithmetic means obtains the amount of consumed developer based upon the summation value that has been stored in said memory.

4. The apparatus according to claim 1, wherein said estimating means includes:

counting means for counting a number of times that a drive operation has been performed by said driving means in order to supply the developer from the developer supply unit; and arithmetic means for obtaining an amount of consumed developer that corresponds to the number of times a drive operation has been performed as counted by said counting means, wherein said estimating means estimates the amount of developer remaining based upon an initial amount of developer in the developer supply unit and the amount of consumed developer as calculated by said arithmetic means.

5. The apparatus according to claim 4, wherein the developer supply unit includes a memory for storing, in non-volatile fashion, a summation value of the number of times drive has been performed as counted by said counting means, and wherein said arithmetic means obtains the amount of consumed developer based upon the summation value that has been stored in said memory.

6. The apparatus according to claim 1, further comprising:

determination means for determining whether the amount of developer inside the developing unit falls within a prescribed range; and control means, responsive to a determination by said determination means that the amount of developer does not fall within the prescribed range, for exercising control so as to drive said driving means in such a manner that the amount of developer inside the developing unit is maintained within the prescribed range.

7. The apparatus according to claim 6, wherein said developing unit includes a stirring chamber for stirring the developer, wherein said stirring chamber has a volume capable of accommodating developer in an amount greater by a prescribed amount than a maximum amount of the prescribed range.

8. The apparatus according to claim 1, further comprising:

sensing means for sensing that no developer is being supplied from the developer supply unit, wherein after said output means outputs said information, an image forming operation is inhibited in a case where said sensing means senses that no developer is being supplied from the developer supply unit.

9. The apparatus according to claim 8, wherein said sensing means includes:

determination means for determining whether the amount of developer inside the developing unit falls within a prescribed range; and control means, responsive to a determination by said determination means that the amount of developer does not fall within the prescribed range, for exercising control so as to drive said driving means in such a manner that the amount of developer inside the developing unit is maintained within the prescribed range, wherein in a case where there is no change in the amount of developer determined by said determination means regardless of a control operation performed by said control means, then said sensing means senses that no developer is being supplied from said developer supply unit.

10. The apparatus according to claim 1, wherein the prescribed amount of driving by said driving means is a driving amount for supplying developer, which corresponds to an amount equivalent to a maximum error in the amount estimated by said estimating means, from the developer supply unit to the developing unit.

11. A method of controlling an image forming apparatus for forming an image by developing the image by a developing unit using a developer supplied from a replaceable developer supply unit, the method comprising:

an estimating step of estimating amount of developer remaining inside the developer supply unit;

a supply step of supplying developer inside the developer supply unit to the developing unit in a prescribed amount in a case where it has been estimated in said estimating step that there is substantially no developer remaining; and an output step of outputting information, which indicates that there is no developer remaining inside the developer supply unit, after said supply step.

12. The method according to claim 11, wherein said estimating step includes:

a counting step of counting a number of dots of an image that has been formed using the developer supply unit; and an arithmetic step of obtaining an amount of consumed developer that corresponds to a count value obtained in said counting step, wherein said estimating step estimates the amount of developer remaining based upon an initial amount of developer in the developer supply unit and the amount of consumed developer as calculated in said arithmetic step.

13. The method according to claim 12, wherein the developer supply unit includes a memory for storing, in a non-volatile fashion, a summation value of the number of dots that has been counted in said counting step, and the amount of consumed developer is obtained at said arithmetic step based upon the summation value that has been stored in the memory.

14. The method according to claim 11, wherein said estimating step includes:

a counting step of counting a number of times the developer inside the developer supply unit is supplied to the developing unit; and an arithmetic step of obtaining an amount of consumed developer that corresponds to the number of times developer has been supplied as counted in said counting step, wherein said estimating step estimates the amount of developer remaining based upon an initial amount of developer in the developer supply unit and the amount of consumed developer as calculated in said arithmetic step.

15. The method according to claim 14, wherein the developer supply unit includes a memory for storing, in a non-volatile fashion, a summation value of the number of times developer has been supplied as counted in said counting step, wherein the amount of consumed developer is obtained in said arithmetic step based upon the summation value that has been stored in said memory.

16. The method according to claim 11, further comprising:

a determination step of determining whether the amount of developer inside the developing unit falls within a prescribed range; and a control step, responsive to a determination at said determination step that the amount of developer does not fall within the prescribed range, of exercising control so as to control the supply of developer by the developer supply unit in such a manner that the amount of developer inside the developing unit is maintained within the prescribed range.

17. The method according to claim 11, further comprising:

a sensing step of sensing that no developer is being supplied from the developer supply unit, wherein after the information is output in said output step, an image forming operation is inhibited in a case where it is sensed in said sensing step that no developer is being supplied from the developer supply unit.

18. The method according to claim 17, wherein said sensing step includes:

a determination step of determining whether the amount of developer inside the developing unit falls within a prescribed range; and a control step, responsive to a determination in said determination step that the amount of developer does not fall within the prescribed range, of exercising control so as to control the supply of developer by the developer supply unit in such a manner that the amount of developer inside the developing unit is maintained within the prescribed range, wherein in a case where there is no change in the amount of developer determined at said determination step regardless of a control operation performed in said control step, then it is sensed at said sensing step that no developer is being supplied from the developer supply unit.

19. The method according to claim 11, wherein the prescribed amount of supply in said supply step is for supplying developer, which corresponds to an amount equivalent to a maximum error in the amount estimated in said estimating step, from the developer supply unit to the developing unit.

20. An image forming apparatus for forming an image by developing the image by a developing unit using a developer supplied from a developer supply unit, the apparatus comprising:

a developer supply section configured to supply a developer from the developer supply unit to the developing unit;

a first sensing unit configured to sense an mount of developer remaining in the developer supply unit;

a second sensing unit configured to sense an amount of developer in the developing unit; and a controller configured to drive said developer supply section based upon result of sensing by said second sensing unit, wherein in a case where said first sensing unit has sensed that there is substantially no developer remaining, said controller drives said developer supply section a prescribed amount while image formation is being carried out regardless of a detection result of the second sensing unit.

21. The apparatus according to claim 20, wherein said controller halts the image forming operation in a case where the amount of developer sensed by said second sensing unit is less than a prescribed amount.

22. The apparatus according to claim 20, wherein the developer supply unit includes a storage unit for storing information; and in a case where said first sensing unit has sensed that there is substantially no developer remaining, said controller stores information, which indicates that there is no longer any developer remaining, in the storage unit after said developer supply section has been driven a prescribed amount.

23. The apparatus according to claim 20, wherein the developer supply unit is removably installed in the image forming apparatus; and in a case where said first sensing unit has sensed that there is substantially no developer remaining, said controller stores information, which indicates replacement of the developer supply unit, in the storage unit after said developer supply section has been driven a prescribed amount.

24. A method of controlling an image forming apparatus for forming an image by developing the image by a developing unit using a developer supplied from a developer supply unit, the method comprising:

a first sensing step of sensing an amount of developer remaining in the developer supply unit;

a second sensing step of sensing an amount of developer in the developing unit; and a first driving step of driving a developer supply section, which supplies a developer from the developer supply unit to the developing unit, based upon a detection result of sensing in said second sensing step; and a second driving step of driving the developer supply section a prescribed amount while image formation is being carried out regardless of the detection result of the second sensing step, in a case where it is has been sensed in said second sensing step that there is substantially no developer remaining in the developer supply unit.

25. The method according to claim 24, further comprising:

a step of halting image formation in a case where the amount of developer sensed in said second sensing step is less than a prescribed amount.

26. The method according to claim 24, wherein the developer supply unit includes a storage unit for storing information; and said method further comprises:

a step of storing information, which indicates that there is no longer any developer remaining, in the storage unit after the developer supply member has been driven a prescribed amount, in a case where it has been sensed in said first sensing step there is substantially no developer remaining.

27. An image forming apparatus for forming an image by developing the image by a developing unit using a developer supplied from a developer supply unit, said apparatus comprising:

a developer supplying member configured to supply the developer from the developer supply unit to the developing unit;

a first detection unit configured to detect a remainder of the developer in the developer supply unit; and a controller configured to drive said developer supplying member to supply the developer to the developing unit based upon image information of an image to be developed using the developer, wherein said controller drives said developer supplying member in a predetermined amount regardless of the image information while forming the image, in a case where said first detection unit detects that the remainder of the developer is less than a predetermined value.

28. An image forming method of forming an image by developing the image by a developing unit using a developer supplied from a developer supply unit, said method comprising:

a remainder detection step of detecting a remainder of the developer in the developer supply unit;

a first supply step of driving a developer supplying member which supplies the developer from the developer supply unit to the developing unit, to supply the developer to the developing unit based upon image information of an image to be developed using the developer; and a second supply step of driving the developer supplying member in a predetermined amount regardless of the image information while forming the image, in a case where it is detected in said remainder detection step that the remainder of the developer is less than a predetermined value.

* * * * *